US006543495B2

(12) United States Patent
Hougland

(10) Patent No.: US 6,543,495 B2
(45) Date of Patent: Apr. 8, 2003

(54) MULTIPLE ACCESS CONTAINER AND METHODS FOR THE TRANSFER OF FLUENT MATERIALS

(75) Inventor: Jerry M. Hougland, Oakdale, CA (US)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 09/934,769

(22) Filed: Aug. 22, 2001

(65) Prior Publication Data

US 2003/0037835 A1 Feb. 27, 2003

(51) Int. Cl.[7] ..... B65B 1/04; B65B 3/04; B65B 37/00; B67C 3/00

(52) U.S. Cl. ..... 141/234; 141/105; 141/114; 141/107; 141/236; 141/313

(58) Field of Search ..... 141/1, 10, 100, 141/102, 105, 106, 107, 114, 234, 236, 247, 313, 316; 222/476, 504, 1; 137/613, 628, 630.16

(56) References Cited

U.S. PATENT DOCUMENTS

| | | | | | |
|---|---|---|---|---|---|
| 3,173,579 | A | | 3/1965 | Curie et al. | 222/105 |
| 3,178,063 | A | | 4/1965 | Cox, Jr. et al. | 222/105 |
| 3,516,452 | A | | 6/1970 | Scholle | 141/18 |
| 3,951,284 | A | | 4/1976 | Fell et al. | 214/152 |
| 4,232,803 | A | | 11/1980 | Muller et al. | 222/105 |
| 4,325,401 | A | | 4/1982 | Ukai et al. | 137/240 |
| 4,445,550 | A | | 5/1984 | Davis et al. | 141/329 |
| 4,447,230 | A | * | 5/1984 | Gula et al. | 604/122 |
| 4,480,426 | A | | 11/1984 | Wach et al. | 53/576 |
| 4,493,179 | A | | 1/1985 | Brak | 53/576 |
| 4,494,363 | A | | 1/1985 | Rica et al. | 53/426 |
| 4,524,563 | A | | 6/1985 | Sassi | 53/426 |
| 4,589,577 | A | | 5/1986 | Welsh et al. | 222/518 |
| 4,715,165 | A | | 12/1987 | Thorogood | 53/469 |
| 4,750,311 | A | | 6/1988 | Catelli | 53/281 |
| 4,836,418 | A | | 6/1989 | Dinslage | 222/82 |
| 4,848,594 | A | | 7/1989 | Bjorkengren et al. | 222/1 |
| 4,999,978 | A | | 3/1991 | Kohlbach et al. | 53/512 |
| 5,031,792 | A | | 7/1991 | Russo, Sr. | 220/403 |
| 5,087,235 | A | | 2/1992 | Lafleur | 493/212 |
| 5,370,164 | A | | 12/1994 | Galloway | 141/329 |
| 5,373,872 | A | | 12/1994 | Mueller | 141/10 |
| 5,390,814 | A | | 2/1995 | Christine et al. | 220/465 |
| 5,449,027 | A | | 9/1995 | Mueller | 141/10 |
| 5,467,806 | A | | 11/1995 | Stricklin et al. | 141/346 |
| 5,479,955 | A | | 1/1996 | Roodvoets et al. | 137/15 |
| 5,639,064 | A | | 6/1997 | deCler et al. | 251/149.5 |
| 5,740,945 | A | | 4/1998 | Shipway | 222/1 |
| 5,743,313 | A | | 4/1998 | Josefsson | 141/330 |
| 5,989,423 | A | * | 11/1999 | Kamen et al. | 210/180 |
| 6,050,451 | A | | 4/2000 | Hess, III et al. | 222/92 |
| 6,068,031 | A | | 5/2000 | Lataix et al. | 141/346 |

FOREIGN PATENT DOCUMENTS

| | | |
|---|---|---|
| DE | 19839841 | 3/2000 |

* cited by examiner

*Primary Examiner*—Timothy L. Maust
(74) *Attorney, Agent, or Firm*—Wood, Herron & Evans, L.L.P.

(57) ABSTRACT

Apparatus and methods for the transfer of a fluent material to or from a container. The container has a holding portion adapted to hold the fluent material and a transfer assembly having a flexible conduit and multiple access ports. The access ports are positioned in spaced apart relationship along the flexible conduit, which has a flow channel in fluid communication with the holding portion. Each of the access ports is operable for selectively transferring fluent material. After a first access port is used to transfer a quantity of fluent material, the section of the conduit carrying the first access port is hermetically or mechanically divided from upstream sections of the conduit. Successive transfers that either dispense fluent material from the holding portion or add fluent material to the holding portion are performed in a like manner using the remaining access ports.

44 Claims, 2 Drawing Sheets

MULTIPLE ACCESS CONTAINER AND METHODS FOR THE TRANSFER OF FLUENT MATERIALS

FIELD OF THE INVENTION

The present invention generally relates to apparatus and methods for transferring a fluent material to or from a bulk container.

BACKGROUND OF THE INVENTION

Fluent materials, such as liquids or granular powders, are commonly packaged inside large-volume bulk containers to facilitate shipment. Conventional bulk containers are sized to hold a large volume of fluent material so as to reduce the cost of packaging and shipping. Common fluent materials include food products, pharmaceuticals, fuels, chemicals, beverages, and the like. Certain fluent materials are commercially sterilized or pasteurized and packaged by processors in bulk containers under aseptic or hygienic conditions. For example, liquid food products and liquid pharmaceutical products are frequently processed or sterilized under aseptic conditions and packaged in an aseptic manner into a bulk container which preserves the asepsis. Other fluent materials are rendered hygienic, such as by pasteurization, and packaged into hermetically-sealed or air-tight bulk containers for shipment. Fluent materials may also be handled in an unprocessed state and packaged into a hermetically-sealed or air-tight bulk container.

One common type of bulk container is a large-capacity flexible bag, which is usually housed within a rigid outer housing, a flexible outer housing, a drum, or a box. The flexible bag is provided with an access port or fitment which serves as an inlet through which the fluent material can be introduced into the bag and which can subsequently be sealed to protect the contents of the bulk container against contamination. The fitment may also serve as an outlet for dispensing fluent material from the flexible bag. Alternatively, a separate fitment may serve as the outlet or the filled flexible bag can simply be cut so that the fluent material may be poured from the flexible bag.

In handling hygienic or commercially-sterile fluent materials, it is extremely important that the interior of the bulk container and its content of fluent product remain isolated from the time of processing and filling throughout the fluid transfer processes that either dispense the contents or add additional fluent material to the contents. The fitment through which fluent material is transferred must be sealed to prevent entry of contaminants, such as microorganisms. The fitment may be provided with a removable closure plug or may be filled and closed by sealing the fitment with a sheet or diaphragm of sealing material. This sheet of sealing material is removed, such as by piercing or rupturing, to allow transfer of fluent material after an external connection has been made between the fitment and a fill/discharge line. The fluent material inside the bulk container may be dispensed by a single dispensing operation or may be filled by a single filling operation. Alternatively, a valve may be attached to the fitment to regulate the flow of fluent material so that the bulk container may be partially emptied in multiple dispensing procedures or incrementally filled in multiple filling procedures. The valve permits fluent material to be selectively discharged from the container.

The fill/discharge line, any valve connected to the fitment, and the area about the fitment must be hygienically sanitized or sterilized before fluent material is transferred to the fill/discharge line, as in the case of aseptic or commercially-sterile fluent material handling. Due to the potential infiltration of contamination, such as microorganisms, from the surrounding environment, the fluent material can be contaminated by multiple filling or dispensing procedures unless extraordinary precautions are taken. To prevent contamination that might, for example, compromise the asepsis of the fluent material inside the bulk container, all areas and surfaces of the valve that the fluent material might contact during the filling or dispensing operation must be sanitized or sterilized.

Thus, there is a need for an apparatus and method that will allow a processor to repeatedly dispense quantities of a fluent material from a bulk container or to incrementally fill a bulk container with quantities of a fluent material or materials without contaminating fluent material present inside the bulk container.

SUMMARY OF THE INVENTION

The present invention generally provides containers configured to hold and allow the selective transfer of a fluent material and methods effective for the selective transfer of quantities of a fluent material under conditions that prevent contamination of fluent material inside the container. After connection and proper sanitization or sterilization of the fill/discharge line and associated components, the container of the present invention permits selective dispensing or filling of quantities of fluent material into or from the container while easily integrating into existing processing and transferring operations.

The container generally comprises a holding portion having an interior configured to hold a fluent material, such as a liquid food product, a flexible conduit defining a flow channel, a first access port in fluid communication with a first section of the flexible conduit and a second access port in fluid communication with a second section of the flexible conduit. The holding portion may have a wide variety of capacities and constructions. The flow channel is in fluid communication with the interior of the holding portion and the second section is located nearer to the interior of the holding portion than the first section. The first and second access ports each have a sealed condition which prohibits the flow of fluent material therethrough and an unsealed condition that permits fluent material to flow therethrough. The first section of the flexible conduit is configured to be selectively divided or isolated from the second section to prevent outward leakage of fluent material and/or to prevent entry of contaminants through the first access port after the first access port is placed in the unsealed condition, a quantity of the fluent material is transferred through the first access port, and the flow of the fluent material through the first access port is subsequently discontinued. The division can be accomplished hermetically, aseptically, sanitarily, mechanically, or by heat-sealing.

According to the present invention, a method of transferring a fluent material to or from a holding portion of a container comprises providing a container with a flexible conduit having a plurality of access ports spaced along its length. One end of the flexible conduit is in fluid communication with the holding portion of the container. A first quantity of the fluent material is transferred using a first access port of the plurality of access ports. Thereafter, the flexible conduit is divided or isolated between the first access port and the holding portion to prevent outward leakage of fluent material and/or to prevent the entry of contaminants through the first access port into the holding portion. Thereafter, a second quantity of the fluent material is transferred using a second access port of the plurality of access ports.

BRIEF DESCRIPTION OF THE DRAWINGS

Various advantages, objectives, and features of the invention will become more readily apparent to those of ordinary skill in the art upon review of the following detailed description of the preferred embodiments, taken in conjunction with the accompanying drawings.

DETAILED DESCRIPTION OF THE PREFERRED EMBODIMENTS

The present invention generally relates to a transfer assembly for dispensing a fluent material contained in a bulk container or for filling the bulk container with the fluent material. The transfer assembly of the present invention permits the fluent material within the bulk container to be partially dispensed by a series of successive dispensing operations or filled by a series of successive filling operations without contaminating the holding portion of the container. Thus, the bulk container does not have to be emptied of its contents of fluent material in a single dispensing operation nor does the bulk container have to be filled to capacity with fluent material in a single filling operation. Each dispensing or filling operation opens an access port in a conduit having a flow channel that leads to the interior of the bulk container. After the transfer is made through the access port, the transfer assembly can be resealed to close the flow channel so that the bulk container is isolated against contamination from the surrounding environment until another quantity of the fluent material is transferred.

Figure 1:
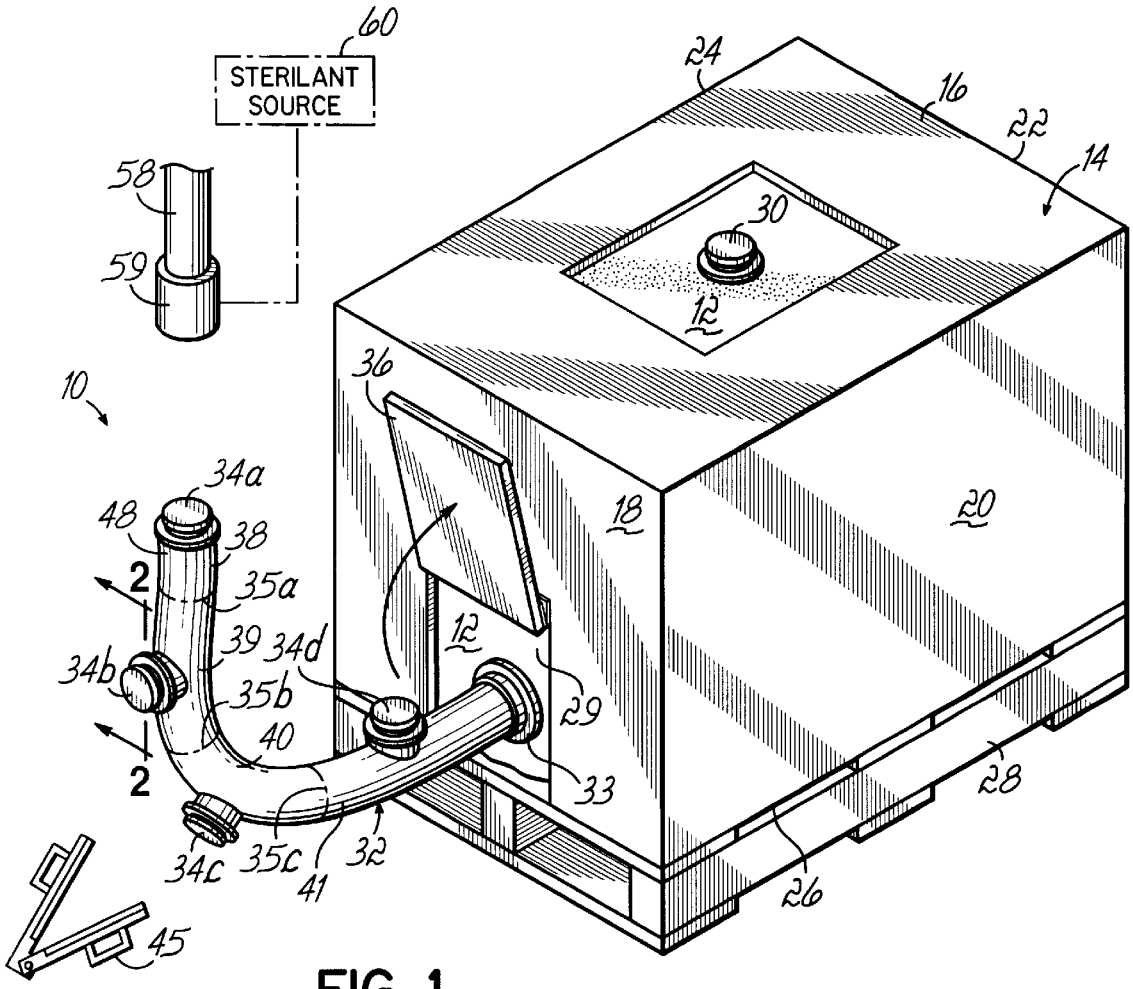
FIG. 1 is a perspective view of a container for a fluent material having a transfer assembly constructed in accordance with the present invention, in which the transfer assembly is shown filled with fluent material.

Referring to FIG. 1, a transfer assembly 10 constructed in accordance with the present invention is shown attached to a holding portion 12, which is housed within an outer protective housing 14. The assembly of the holding portion 12 and the outer protective housing 14, as illustrated in FIG. 1, is commonly referred to as a bag-in-box container in which the holding portion 12 is a flexible or pliable bag and the outer protective housing 14 is a rigid structure. The transfer assembly 10 of the present invention is also suitable for transferring fluent material to and from containers other than bag-in-box containers of the type described herein by the combination of holding portion 12 and outer protective housing 14. For larger capacity holding portions 12, the outer protective housing 14 may be mounted on a trailer or suspended from a frame.

Outer protective housing 14 has an upper wall 16, four side walls 18, 20, 22, 24, and a bottom wall 26 arranged in a surrounding relationship about the holding portion 12. A door 36, such as the illustrated hinged door, conceals an access opening 29 provided in the side wall 18 and, when in an open condition, permits selective access to the interior of the outer protective housing 14. Outer protective housing 14 is formed of a suitable rigid structural material, such as paper board, cardboard, rigid plastic, plywood, fabric, steel, or laminates, and has the general geometry of a six-sided parallelepiped. Outer protective housing 14 may be supported for lifting and handling on a pallet 28 made of a structurally rigid material such as wood, plastic or metal. Outer protective housing 14 is typically removeably attached to pallet 28.

The holding portion 12 is typically constructed of one or more layers or plies of a plastic or polymer, such as a low density polyethylene, a medium density polyethylene, or the like. The details of an exemplary construction for holding portion 12 are disclosed in U.S. Pat. No. 4,445,550, issued May 1, 1984 and entitled "Flexible Walled Container Having Membrane Fitment For Use With Aseptic Filling Apparatus." The disclosure of this patent is hereby incorporated by reference herein in its entirety. The polymer forming the holding portion 12 may be a material that resists oxygen permeation so as to extend the shelf life of fluent materials that are oxygen-sensitive. However, the present invention is not so limited for applications of the present invention with fluent materials that are not oxygen-sensitive or that can tolerate exposure to oxygen without experiencing significant degradation.

Holding portion 12 expands to accept an amount of fluent material up to its capacity and is collapsible when fluent material is discharged therefrom. The holding portion 12 provides a reservoir that holds an amount of fluent material that is equal to or less than its full capacity. In a typical application, holding portion 12 has a capacity to hold about 300 gallons of the fluent material. The transfer assembly 10 may be used with holding portions 12 of other capacities, such as between about 5 gallons and about 5000 gallons, and formed of different materials without departing from the spirit and scope of the present invention. The internal dimension and/or configration of the outer protective housing 14 would vary according to the capacity of the holding portion 12.

Fluent materials which may be held by the holding portion 12 and transferred therefrom using the transfer assembly 10 of the present invention include, but are not limited to, food products, pharmaceuticals, chemicals, fuels, and beverages. In particular, food products that may be transferred using the present invention include liquid food products, concentrated liquid food products, or particulated food products in a liquid carrier. The fluent material held by holding portion 12 may be in a raw or unprocessed state, a partially processed state, a hygienic state, a commercially-sterile state, or an aseptic state.

Holding portion 12 is provided with one or more filling fitments, such as filling fitment 30. Filling fitment 30 is accessible through an access opening in the outer protective housing 14 that is oriented such that the holding portion 12 can be filled in a conventional manner. Filling fitment 30 is molded of a suitable plastic or polymer, such as a high density polyethylene, that may be joined with the polymer or polymers forming the holding portion 12. The interior of the holding portion 12 acts as a reservoir to hold a quantity of the fluent material for transport to a remote location for one or more dispensing operations. A conventional bag filling machine (not shown) is used to fill holding portion 12 with a quantity of the fluent material through filling fitment 30. An exemplary bag filling machine for sterile food product filling is presented in U.S. Pat. No. 4,494,363, entitled "Method and Apparatus for Aseptically Filling Containers," issued Jan. 22, 1985. It is understood that the filling fitment 30 can be omitted from the holding portion 12, in accordance with an aspect of the present invention and as will be described below.

With continued reference to FIG. 1 and according to the present invention, the transfer assembly 10 includes a tube or conduit 32 and a plurality of, for example, four access ports 34*a–d*, such as coupling devices or fitments. Fluent material may be selectively discharged from the holding portion 12 through each of the access ports 34*a–d* in a series of dispensing operations, the holding portion 12 can be filled with fluent material through each of the access ports 34*a–d* in a series of filling operations, or combinations of filling and dispensing operations may be performed to transfer fluent material. The conduit 32 is configured such that multiple transfers of fluent material can be made without contaminating the holding portion 12, as will be detailed below. Conduit 32 is illustrated in FIG. 1 filled with fluent material which applies a pressure, which is hydraulic pressure if the fluent material is liquid, that renders the conduit 32 substantially rigid. However, it is understood that conduit 32 is flexible when not filled with fluent material.

The conduit 32 comprises a tubular side wall 48, illustrated as being substantially cylindrical, that encloses a flow channel which is in fluid communication with the fluent material in holding portion 12. It is appreciated by persons of ordinary skill that conduit 32 could be integrally sealed with the material forming the holding portion 12 without the aid of an intervening structure such as flange 33. Conduit 32 is formed of a flexible material that can be sealingly attached via a flange 33 to holding portion 12. An exemplary flexible material suitable for forming conduit 32 is a polymer, such as a low-density polyethylene or the like. The polymer forming the holding portion 12 may be a material that resists oxygen permeation so as to extend the shelf life of fluent materials that are oxygen-sensitive. However, the present invention is not so limited for use in the present invention to hold fluent materials that are not oxygen-sensitive or that tolerate at least some exposure to oxygen without experiencing significant degradation.

Due to its flexibility, the transfer assembly 10 can be concealed or coiled in a shipment or stored position (not shown), defined between the outside of the holding portion 12 and the inside of the outer protective housing 14, and deployed in a transfer position, as shown in FIG. 1. In the shipment position, the outer protective housing 14 protects the conduit 32 from damage during transport and handling. In the transfer position, the transfer assembly 10 is available for performing a filling operation or a dispensing operation. Transfer assembly 10 is accessed for deployment from the shipment position, for example, by opening the door 36, retrieving the assembly 10 from its shipment position, and positioning the assembly 10 in its transfer position.

Conduit 32 is designed to be sectioned into a plurality of, for example, four channel sections 38, 39, 40, and 41. Adjacent pairs of channel sections 38–41 are separated by a respective one of a plurality of, for example, three shared boundaries 35*a–c*, as shown diagrammatically by dashed lines on FIG. 1. Although the present invention is not so limited, the shared boundaries 35*a–c* can be clearly demarcated such as by providing an embossed pattern on or about an outer surface of conduit 32. The demarcations would provide a reference location or guide at which adjacent pairs of channel sections 38, 39, 40, and 41 can be isolated.

Each of the channel sections 38–41 carries at least one of the plurality of four access ports 34*a–d*. The access ports 34*a–d* have generally cylindrical side walls that extend radially outwardly with respect to the longitudinal axis of the conduit 32 and project beyond the outer surface of the conduit 32. The access ports 34*a–d* are provided at circumferentially spaced locations around the conduit 32 and are positioned in spaced apart relationship along the conduit 32. It is understood that the number of channel sections, depicted as a plurality of four channel sections 38–41 in FIG. 1, is not intended to be limiting and that the transfer assembly 10 may have a greater or lesser number of individual channel sections 38–41. Further, the location of each of the shared boundaries 35*a–c* may vary lengthwise along conduit 32, as required, without departing from the spirit and scope of the present invention.

Each of the channel sections 38–41 is adapted to be isolated or divided from the adjacent ones of channel sections 38–41, which would typically occur after a transfer operation is performed. For example, channel section 38 can be isolated from channel section 39 by forming a transverse seal 31 in conduit 32 at, or near, shared boundary 35*a* using a sealing device 45. The sealing device 45 is operable for isolating any of the channel sections 38–41 from upstream portions of conduit 32 and holding portion 12. The sealing device 45 is preferably a conventional heat sealer or thermal impulse sealer having a pair of heated seal bars that are caused to come together to clamp conduit 32 therebetween and effect a heat seal at or near one of the shared boundaries 35*a–c* between an adjacent pair of channel sections 38–41. However, any conventional sealing device operable for effecting the transverse seal 31 of conduit 32 may be equivalently used. An exemplary family of sealing devices suitable for use as the sealing device 45 is available commercially from TEW International Co., Ltd. (Taipei, Taiwan) under the TISH-product line and includes the TISH-100, -200, -300 and -400 models.

Figure 1A:
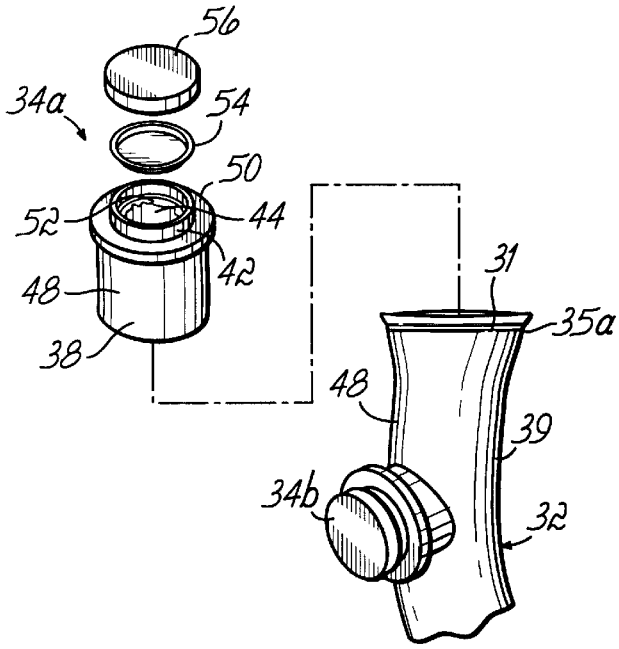
FIG. 1A is an enlarged view of a portion of FIG. 1.

Referring to FIGS. 1 and 1A, after access port 34*a* is used in a transfer operation, the sealing device 45 is operable to flatten and collapse the conduit 32 at a position along its length, such as at or near the shared boundary 35*a* between channel sections 38 and 39. When flattened and collapsed, opposite side portions of conduit 32 contact and the heated seal bars of the sealing device 45 melt and fuse the contacting opposite side portions of the conduit 32 to effect the transverse seal 31 for closing the end terminating channel section 39 in a substantially fluid-tight fashion and, therefore, establishing a new terminus for the conduit 32. The transverse seal 31 engagement prevents the passage of significant amounts of fluent material and, preferably, prohibits the passage of any amount of fluent material. In addition, the transverse seal 31 preferably prevents the entry of contaminants, such as microorganisms, which would otherwise contaminate the upstream channel sections 39, 40 and 41 and the holding portion 12. The transverse seal 31 of conduit 32 may be air-tight or hermetic to prevent the entry of oxygen-containing air that could degrade fluent materials that are oxygen-sensitive. However, the present invention is not so limited and the transverse seal 31 of conduit 32 may be oxygen-permeable, but substantially or completely liquid-tight, for transferring fluent materials that are not oxygen-sensitive or those fluent materials that tolerate some exposure to oxygen without experiencing significant degradation.

In other embodiments of the present invention, the transverse seal 31 of conduit 32 may be accomplished with a sealing device 45 such as a conventional mechanical closure element or clamp, that applies a clamping force to flatten and seal the conduit 32 at a position along its length, such as at or near the shared boundary 35*a* between channel sections 38 and 39. In other embodiments of the present invention, the transverse seal 31 of conduit 32 may be formed by flattening and sealing without the assistance of a sealing device 45 or the assistance of a mechanical device, such as by folding, pinching, tying and the like. The transverse seal 31 of conduit 32 is preferably liquid-tight but may be substantially liquid-tight if some leakage of fluent material past transverse seal 31 can be tolerated. The transverse seal 31 of conduit 32 need only be operable to prevent infiltration of types of contaminants that can degrade or damage the fluent material. For example, the transverse seal 31 of conduit 32 should prevent the entry of microorganisms that would otherwise degrade the state of fluent materials such as sterile pharmaceuticals and aseptic food products, but is not so limited if the fluent material is not sensitive to the presence of microorganisms, such as a fuel, a chemical, a raw food product, an unprocessed food product, or the like.

A common cutting implement (not shown), such as a knife, may be used to sever the appropriate one of channel sections 38–41, such as channel section 38, from the conduit 32 that was used for transferring fluent material after the transverse seal 31 is effected. Alternatively, the sealing device 45 may further include a trimmer for severing the appropriate one of channel sections 38–41, such as channel section 38, from the conduit 32, that was used for transferring fluent material after the transverse seal 31 is created and the heat seal bars are withdrawn. It is understood by those of ordinary skill in the art that each channel section, for example channel section 38 that is shown removed in FIG. 1A, may remain connected to the conduit 32, after a transfer operation which allows fluent material to flow through access port 34*a*, and isolated from the remaining channel sections 39–41. When the holding portion 12 is emptied or otherwise ready for disposal, the transfer assembly 10, the holding portion 12, and the outer protective housing 14 may then be recycled or disposed of separately or as a unit.

The access ports 34*a–d* may comprise any fitment or coupling device that prevents the flow of a fluent material when in a sealed condition and that permits the flow of fluent material when in an unsealed condition. In the sealed condition, the access ports 34*a–d* prevent contamination from the environment surrounding the flexible conduit 32 from entering the flow channel of conduit 32 and prevent outward leakage of the fluent material from the conduit 32. A representative structure suitable for use in the present invention as, for example, access port 34*b* of the access ports 34*a–d* is illustrated in FIG. 2.

Figure 2:
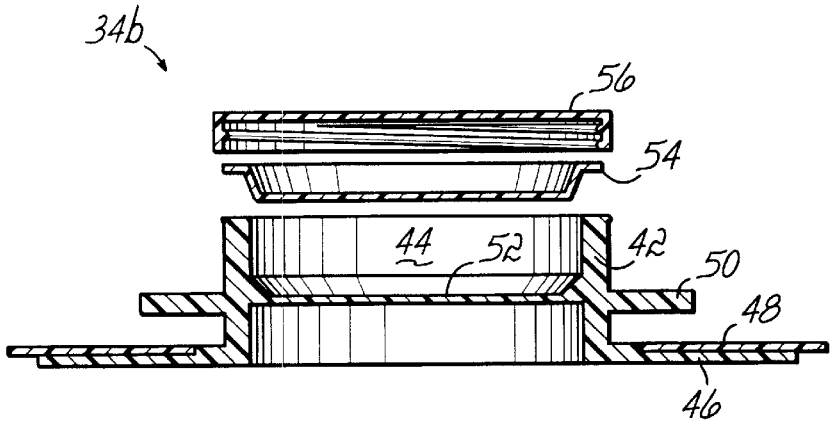
FIG. 2 is a side view of a fitment suitable for use with the transfer assembly of FIG. 1.

With reference to FIGS. 1, 1A, and 2, access port 34*b* includes a substantially cylindrical sidewall 42 forming a fluid passageway 44 and an annular attachment flange 46 extending radially outwardly from sidewall 42. The attachment flange 46 is attached and preferably, hermetically sealed to the periphery of a generally circular opening provided in the wall 48 of the conduit 32. An annular clamping flange 50 extends radially outwardly from sidewall 42 and bears a vertically spaced relationship with the attachment flange 46. Clamping flange 50 accommodates the attachment of a complementary isolation/attachment 59 carried by a fill/discharge line 58. The fill/discharge line 58 routes a flow of the fluent material out of the flow channel of conduit 32 or into the flow channel of the conduit 32 from a source of fluent material. A frangible membrane 52 extends across the fluid passageway 44 and isolates the interior of the conduit 32. The fluid passageway 44 is covered by a lid 54 hermetically sealed to sidewall 42 and an outer protective cap 56. An exemplary coupling device, similar to access port 34*b*, is presented in U.S. Pat. No. 4,445,550, incorporated by reference above.

To initiate a flow of fluent material, the lid 54 and the protective cap 56 are removed from the access port 34*b* and the isolation/attachment structure 59 of the fill/discharge line 58 is attached to the clamping flange 50. If so desired, a sterilant, such as steam, hot water, or an active chemical agent, may be provided to the isolation/attachment structure 59 from a sterilant source 60 for sanitizing or sterilizing the access port 34*b*, the fill/discharge line 58, and the isolation/attachment structure 59. However, the present invention is not so limited and it is understood that sterilant need not be supplied for those transfer operations of fluent materials using transfer assembly 10 for which sanitization or sterilization is not a concern. The frangible membrane 52 may be pierced, removed, or ruptured by, for example, a portion of the isolation/attachment structure 59 or a separate implement (not shown) to initiate a filling operation or a dispensing operation that transfers fluent material to or from the holding portion 12.

Figure 3:
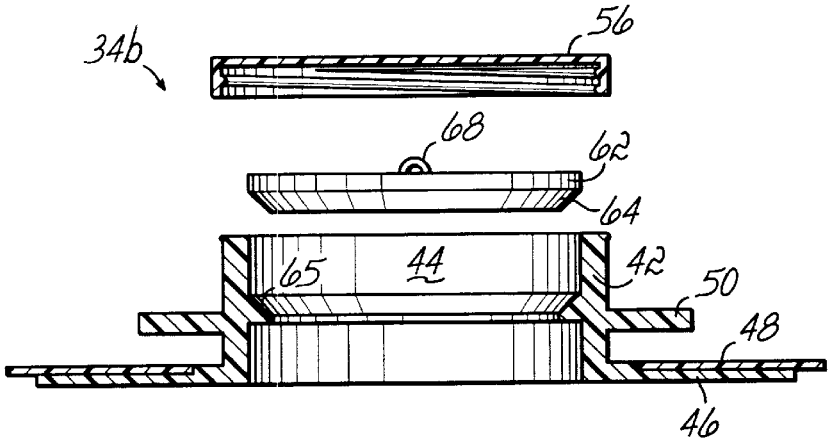
FIG. 3 is a side view of another fitment suitable for use with the transfer assembly of FIG. 1.

With reference to FIG. 3 in which like reference numerals refer to like features in FIG. 2, another representative structure is presented which is suitable for use with the transfer assembly 10 of the present invention as, for example, access port 34*b*. Access port 34*b* has a plug 62 that is dimensioned and configured to be removably inserted into the cylindrical interior of the fluid passageway 44. The plug 62 includes a tapered end 64 which is received in a sealed manner within a tapered portion 65 of fluid passageway 44. The plug 62 includes a structure, illustrated in FIG. 3 as a notched tang 68, which can be grasped by an implement or a gripper (not shown) to remove plug 62 from the tapered portion 65 to permit the flow of fluent material from access port 34*b* and/or to insert plug 62 into the tapered portion 65 to halt the flow of fluent material.

Figure 4:
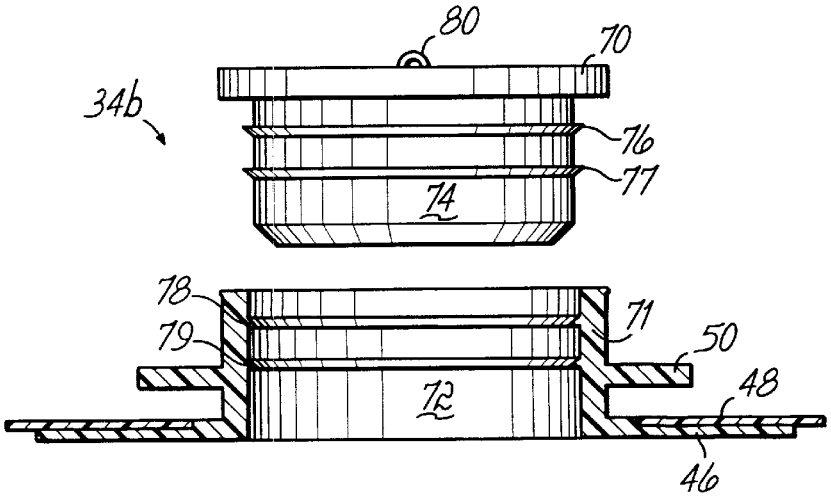
FIG. 4 is a side view of another fitment suitable for use with the transfer assembly of FIG. 1.

With reference to FIG. 4 in which like reference numerals refer to like features in FIG. 2, another representative structure is presented which is suitable for use with the transfer assembly 10 of the present invention as, for example, access port 34*b*. Access port 34*b* has a plug 70 that is dimensioned and configured to be removably inserted into the cylindrical interior of a fluid passageway 72 defined by a tubular side wall 71. The plug 70 includes a plug member 74 and a pair of radially outwardly-projecting ridges 76, 77 that extend about the circumference of the plug member 74. The cylindrical interior of the fluid passageway 72 includes a pair of radially inwardly-projecting ridges 78, 79 that extend about the circumference of fluid passageway 72. The outwardly-projecting ridges 76, 77 are configured and positioned to engage a respective one of radially inwardly-projecting ridges 78, 79 when plug 70 is inserted in a sealed position within the fluid passageway 72. The plug 70 includes a structure, illustrated in FIG. 4 as a notched tang 80, which can be grasped by an implement or a gripper (not shown) to remove plug 70 from the fluid passageway 72 to permit the flow of fluent material from access port 34*b* and/or to insert plug 70 into the fluid passageway 72 to halt the flow of fluent material.

By way of example and not limitation, the conduit 32 may have an outer diameter of about six (6) inches and a length of about ten (10) feet and the access ports 34*a–d* may have an outer diameter of about four (4) inches. It is understood that the foregoing specific dimensions for the conduit 32 and the access port 34*a–d* have been set forth herein for purposes of clarity of description. It is contemplated that the transfer assembly 10, including the conduit 32 and the access ports 34*a–d*, may be constructed with many different dimensions and profiles.

The basic operation of the transfer assembly 10 may be understood with reference to FIGS. 1, 1A, and 2. In this regard, door 36 is opened and the transfer assembly 10 is removed from its shipment or stored position within outer protective housing 14 for deployment in the deployed position as shown in FIG. 1. After removing the outer protective cap 56 and the lid 54 of, for example, the access port 34*a* of the channel section 38, the isolation/attachment structure 59 of the fill/discharge line 58 is attached to the clamping flange 50. If appropriate, a flow of sterilant from sterilant source 60 is used to sterilize or sanitize the portions of the access port 34*a*, fill/discharge line 58 and isolation/attachment structure 59 with which the fluent material will be in contact. The frangible membrane 52 is ruptured to permit fluent material to flow through fluid passageway 44 of access port 34*a*. If the transfer is a dispensing operation, fluent material flows out of the interior of holding portion 12 into the flow channel of conduit 32 and out of the fluid passageway 44 into the fill/discharge line 58. If the transfer is a filling operation, fluent material flows from the fill/discharge line 58 into the fluid passageway 44 and through the flow channel of conduit 32 into the holding portion 12.

After the desired quantity of fluent material is transferred, the flow of fluent material through the transfer assembly 10 is discontinued. The transferred quantity of fluent material may comprise the total volume of fluent material held by holding portion 12 or a fraction thereof. The channel section 38 is divided from the upstream portions of conduit 32 by forming the transverse seal 31 at or near the shared boundary 35*a* with channel section 39. The transverse seal 31 is formed using sealing device 45, which may hermetically or sanitarily divide sections 38 and 39, or by using a mechanical closure or another technique as contemplated by the present invention. After dividing sections 38 and 39, the channel section 38 may be severed from the conduit 32 at or near the shared boundary 35*a* and discarded. Alternatively, channel section 38 may remain attached to conduit 32 in its divided condition.

Subsequently, fluent material can be transferred in a similar manner through the access port 34*b* carried by channel section 39. After the dispensing operation, the channel section 39 is divided from the channel section 40 by providing another transverse seal 31 at or near the shared boundary 35*b*. The transverse seal 31 that divides sections 39 and 40 may be hygienically or aseptically formed with sealing device 45 or may be accomplished by a mechanical closure or another technique as contemplated by the present invention. After providing the transverse seal 31, the channel section 39 may be severed from the conduit 32 at or near the shared boundary 35*b* with channel section 39 and discarded. Alternatively, channel section 39 may remain attached to conduit 32 in its divided condition.

In a like manner, additional quantities of fluent material may be transferred using channel sections 40, 41 of conduit 32 until all of the channel sections 38–41 have been utilized for either fill operations or dispensing operations. It is understood that channel sections 38–41 used to transfer fluent material may remain attached to conduit 32, after dividing with a respective one of the transverse seals 31, and the transfer assembly 10, holding portion 12 and outer protective housing 14 may thereafter be discarded as a unit or recycled as a unit.

While the present invention has been illustrated by a description of a preferred embodiment and while this embodiment has been described in some detail, it is not the intention of the Applicant to restrict or in any way limit the scope of the appended claims to such detail. Additional advantages and modifications will readily appear to those skilled in the art. This has been a description of the present invention, along with the preferred methods of practicing the present invention as currently known. However, the invention itself should only be defined by the appended claims, wherein.

I claim:

1. A container configured to hold and allow selective transferring of a fluent food material, comprising:

a holding portion having an interior configured to hold the fluent food material;

a flexible conduit defining a flow channel, said conduit having a first section and a second section, said flow channel in fluid communication with said interior of said holding portion and said second section located nearer to the interior of said holding portion than said first section and;

a first access port in fluid communication with said first section of said flexible conduit and a second access port in fluid communication with said second section of said flexible conduit, said first access port and said second access port each having a sealed condition which prohibits the flow of the fluent food material therethrough and an unsealed condition that permits the fluent material to flow therethrough, said first section configured to be selectively divided from said second section after said first access port is placed in the unsealed condition, a quantity of the fluent food material is transferred through said first access port, and the flow of the fluent food material through said first access port is subsequently discontinued.

2. The container of claim 1 wherein said flexible conduit has a third section located nearer to said interior of said holding portion than said first section and said second section, and further comprising a third access port in fluid communication with the third section, said third access port having a sealed condition in which prohibits the flow of the fluent material therethrough and an unsealed condition that permits the fluent material to flow therethrough, and said second section of said flexible conduit configured to be selectively divided from said third section after said second access port is placed in the unsealed condition, a quantity of the fluent material is transferred through said second access port, and the flow of the fluent material through said second access port is subsequently discontinued.

3. The container of claim 1 wherein said holding portion includes a rigid outer wall that encloses said interior.

4. The container of claim 1 wherein said holding portion includes a flexible outer wall that encloses said interior.

5. The container of claim 4 further comprising an outer protective housing at least partially surrounding said flexible outer wall of said holding portion.

6. The container of claim 5 wherein said flexible conduit is positionable between a stored position in which said outer protective housing shields said flexible conduit and a deployed position in which said flexible conduit is accessible for selectively transferring the fluent material.

7. The container of claim 1 wherein said flexible conduit comprises a polymer that is heat sealable to isolate said first section of said flexible conduit from said second section and prevent the fluent material from entering said second section from said first section.

8. The container of claim 1 wherein said flexible conduit comprises a polymer that is mechanically sealable to isolate said first section of said flexible conduit from said second section and prevent the fluent material from entering said second section from said first section.

9. The container of claim 1 wherein said flexible conduit is formed of a polymer.

10. The container of claim 1 wherein said first access port and said second access port are configured to couple with a fill/discharge line that accommodates the flow of the fluent material.

11. The container of claim 1 wherein said first section of said flexible conduit is configured to be hermetically divided from said second section.

12. The container of claim 1 wherein said first section of said flexible conduit is configured to be mechanically divided from said second section.

13. A container configured to hold and allow selective transferring of a fluent food material, the container comprising:

a holding portion having a reservoir capable of holding a quantity of fluent food material;

a flexible conduit defining a flow channel in fluid communication with said reservoir of said container, said conduit divided into a plurality of sections along its length; and a plurality of access ports, one of said plurality of access ports in fluid communication with each of said plurality of sections, each of said plurality of access ports each having a sealed condition which prohibits the flow of the fluent food material therethrough and an unsealed condition that permits the fluent food material to flow therethrough, each of said plurality of said sections configured to be selectively divided from upstream sections of said conduit after said access port is placed in the unsealed condition, a quantity of the fluent food material is transferred through said access port, and the flow of the fluent food material through said access port is subsequently discontinued.

14. The container of claim 13 wherein said holding portion includes a rigid outer wall that encloses said interior.

15. The container of claim 13 wherein said holding portion includes a flexible outer wall that encloses said interior.

16. The container of claim 15 further comprising an outer protective housing containing said flexible outer wall of said holding portion.

17. The container of claim 16 wherein said flexible conduit is positionable between a stored position in which said outer protective housing shields said flexible conduit and a deployed position in which said flexible conduit is accessible for selectively transferring the fluent material.

18. The container of claim 15 wherein said flexible conduit is formed of a material that is heat sealable to isolate each of said plurality of sections from adjacent ones of said plurality of sections.

19. The container of claim 15 wherein said flexible conduit is formed of a material that is mechanically sealable to isolate each of said plurality of sections from adjacent ones of said plurality of sections.

20. The container of claim 15 wherein said flexible conduit is formed of a polymer.

21. The container of claim 15 wherein each of said plurality of access ports is configured to couple with a fill/discharge line that accommodates the flow of the fluent material.

22. The container of claim 15 wherein each of said plurality of said sections is configured to be hermetically divided from upstream sections of said conduit.

23. The container of claim 15 wherein each of said plurality of said sections is configured to be mechanically divided from upstream sections of said conduit.

24. A container configured to hold and allow selective transferring of a fluent food product, comprising:

a pliable bag having a reservoir configured to hold the fluent food product;

a protective housing at least partially surrounding the pliable bag;

a flexible conduit defining a flow channel, said flexible conduit having a first section and a second section, said flow channel in fluid communication with said reservoir and said second section located nearer to the reservoir than said first section; and a first access port in fluid communication with said first section of said flexible conduit and a second access port in fluid communication with said second section of said flexible conduit, said first access port and said second access port each having a sealed condition in which prohibits the flow of the fluent material therethrough and an unsealed condition that permits the fluent material to flow therethrough, said flexible conduit configured to be selectively divided between said first section from said second section after said first access port is placed in the unsealed condition, a quantity of the fluent food product is transferred through said first access port, and the flow of the fluent food product through said first access port is subsequently discontinued.

25. The container of claim 24 wherein said flexible conduit has a third section located nearer to said interior of said holding portion than said first section and said second section, and further comprising a third access port in fluid communication with the third section, said third access port having a sealed condition in which prohibits the flow of the fluent material therethrough and an unsealed condition that permits the fluent material to flow therethrough, said first section configured to be selectively divided from said second section, and said second section of said flexible conduit configured to be selectively divided from said third section after said second access port is placed in the unsealed condition, a quantity of the fluent food product is transferred through said second access port, and the flow of the fluent food product through said second access port is subsequently discontinued.

26. The container of claim 24 wherein said flexible conduit is formed of a polymer.

27. The container of claim 24 wherein said first access port and said second access port are configured to couple with a fill/discharge line that accommodates the flow of the fluent food product.

28. The container of claim 24 wherein said flexible conduit is formed of a material that is heat sealable to isolate each of said plurality of sections from adjacent ones of said plurality of sections.

29. The container of claim 24 wherein said flexible conduit is formed of a material that is mechanically sealable to isolate each of said plurality of sections from adjacent ones of said plurality of sections.

30. The container of claim 24 wherein said flexible conduit is positionable between a stored position in which said outer protective housing shields said flexible conduit and a deployed position in which said flexible conduit is accessible for selectively transferring the fluent food product.

31. The container of claim 24 wherein said first access port and said second access port are configured to couple with a fill/discharge line that accommodates the flow of the fluent material.

32. The container of claim 24 wherein said first section of said flexible conduit is configured to be hermetically divided from said second section.

33. The container of claim 24 wherein said first section of said flexible conduit is configured to be mechanically divided from said second section.

34. The container of claim 24 wherein said flexible conduit is positionable between a stored position and a deployed position.

35. A method of transferring a fluent food material to or from a holding portion of a container, the method comprising:

providing the container with a flexible conduit having a plurality of access ports spaced along its length, one end of the flexible conduit in fluid communication with the holding portion;

transferring a first quantity of the fluent food material using a first access port of the plurality of access ports;

dividing the flexible conduit between the first access port and the holding portion to prevent to prevent outward leakage of fluent food material and/or the entry of contaminants through the first access port into the holding portion; and transferring a second quantity of the fluent material using a second access port of the plurality of access ports.

36. The method of claim 35 further comprising the step of severing the portion of the flexible conduit carrying the first access port from the portion of the conduit carrying the remaining ones of the plurality of access ports.

37. The method of claim 35 wherein the dividing step comprises hermetically dividing the flexible conduit between the first access port and the holding portion.

38. The method of claim 37 wherein the flexible conduit is formed from a heat-sealable material and the hermetically division is accomplished by heat sealing.

39. The method of claim 35 wherein the dividing step comprises mechanically dividing the flexible conduit between the first access port and the holding portion.

40. The method of claim 35 wherein the first transferring step comprises dispensing the fluent material from the holding portion through the first access port.

41. The method of claim 35 wherein the first transferring step comprises filling the holding portion with the fluent material through the first access port.

42. The method of claim 35 wherein the first transferring step comprises transferring the first quantity of the fluent material using the first access port under aseptic conditions and the second transferring step comprises transferring the second quantity of the fluent material using the second access port under aseptic conditions.

43. The method of claim 35 wherein the first transferring step comprises transferring the first quantity of the fluent material using the first access port under hygienic conditions and the second transferring step comprises transferring the second quantity of the fluent material using the second access port under hygienic conditions.

44. A container configured to hold and allow selective transferring of a fluent material, comprising:

a holding portion having an interior configured to hold the fluent material;

a flexible conduit defining a flow channel, said conduit having a longitudinal axis, a first section and a second section, said flow channel in fluid communication with said interior of said holding portion and said second section located nearer to the interior of said holding portion than said first section and;

a first sealed access port in fluid communication with said first section of said flexible conduit and a second sealed access port in fluid communication with said second section of said flexible conduit, said first access port and said second access port each having a cylindrical side wall that extends radially outwardly with respect to the longitudinal axis of the conduit, wherein said first access port may be placed in an unsealed condition to permit a quantity of the fluent material to flow therethrough and said first section of said flexible conduit heat sealed from said second section after the flow of the fluent material through said first access port is discontinued.

* * * * *